US009353747B2

(12) United States Patent
Ito et al.

(10) Patent No.: US 9,353,747 B2
(45) Date of Patent: May 31, 2016

(54) SCROLL FLUID MACHINE WITH AXIAL SEALING UNIT

(71) Applicant: ANEST IWATA CORPORATION, Yokohama-shi, Kanagawa (JP)

(72) Inventors: Hiroshi Ito, Yokohama (JP); Shiro Tanigawa, Yokohama (JP); Youhei Midorikawa, Yokohama (JP)

(73) Assignee: ANEST IWATA CORPORATION, Kanagawa (JP)

( * ) Notice: Subject to any disclaimer, the term of this patent is extended or adjusted under 35 U.S.C. 154(b) by 154 days.

(21) Appl. No.: 13/934,945

(22) Filed: Jul. 3, 2013

(65) Prior Publication Data

US 2013/0294956 A1 Nov. 7, 2013

Related U.S. Application Data

(63) Continuation of application No. PCT/JP2011/076848, filed on Nov. 22, 2011.

(30) Foreign Application Priority Data

Jan. 11, 2011 (JP) ..... 2011-003323

(51) Int. Cl.
*F04C 18/02* (2006.01)
*F04C 23/00* (2006.01)
*F04C 27/00* (2006.01)

(52) U.S. Cl.
CPC ..... *F04C 18/0246* (2013.01); *F04C 18/0223* (2013.01); *F04C 18/0253* (2013.01); *F04C 27/008* (2013.01); *F04C 23/001* (2013.01); *F04C 27/005* (2013.01)

(58) Field of Classification Search
CPC ..... F04C 18/0223; F04C 18/0246; F04C 18/0253
See application file for complete search history.

(56) References Cited

U.S. PATENT DOCUMENTS 3,473,728 A 10/1969 Vulliez
5,304,047 A 4/1994 Shibamoto
5,752,816 A * 5/1998 Shaffer ..... 418/55.2
(Continued)

FOREIGN PATENT DOCUMENTS

JP 48-34787 B1 10/1973
JP 59-192884 A 11/1984
(Continued)

OTHER PUBLICATIONS

International preliminary report on patentability mailed Jul. 25, 2013 corresponds to PCT/JP2011/076848.
International Search Report corresponding to PCT/JP2011/076848, dated Feb. 14, 2012.
"XDS Scroll Pumps" http://www.edwardsvacuum.com/Products/List.aspx?r=3, copyright 2012.

*Primary Examiner* — Mary A Davis
(74) *Attorney, Agent, or Firm* — Hauptman Ham, LLP

(57) ABSTRACT

A scroll fluid machine includes a revolving scroll in which a revolving wrap stands upright on an end plate supported revolvably on a drive shaft, and a fixed scroll which is provided opposite the revolving scroll and in which a fixed wrap stands upright on an end plate. The revolving and fixed wraps overlap to form a compression chamber for compressing a fluid by causing the revolving scroll to revolve. The scroll fluid machine further includes a rod-shaped member attached to the end plate of the revolving scroll and extending to a rear surface side of the fixed scroll, which is a side not opposing the revolving scroll. A revolving plate is attached to the rod-shaped member, provided with a pin crank mechanism, and supported revolvably on the drive shaft. The revolving plate is provided with a sealing unit that seals the compression chamber in an axial direction.

4 Claims, 3 Drawing Sheets

(56) References Cited

U.S. PATENT DOCUMENTS

| | | | | |
|---|---|---|---|---|
| 5,951,268 | A * | 9/1999 | Pottier et al. | 418/55.5 |
| 5,961,297 | A | 10/1999 | Haga et al. | |
| 7,467,933 | B2 * | 12/2008 | Ni | 418/55.5 |
| 7,537,440 | B2 * | 5/2009 | Goodwin et al. | 418/55.2 |
| 7,611,344 | B2 * | 11/2009 | Ni | 418/55.5 |
| 2003/0223898 | A1 | 12/2003 | Fujioka et al. | |
| 2005/0249623 | A1 | 11/2005 | Tsuchiya et al. | |

FOREIGN PATENT DOCUMENTS

| | | | |
|---|---|---|---|
| JP | 5-060078 | A | 3/1993 |
| JP | 5-187372 | A | 7/1993 |
| JP | 8-270582 | A | 10/1996 |
| JP | 2003-201977 | A | 7/2003 |
| JP | 2004-092559 | A | 3/2004 |
| JP | 2005-320885 | A | 11/2005 |

* cited by examiner

SCROLL FLUID MACHINE WITH AXIAL SEALING UNIT

RELATED APPLICATIONS

The present application is a continuation of International Application Number PCT/JP2011/076848, filed Nov. 22, 2011, which claims the benefit of Japanese Application Number 2011-003323, filed Jan. 11, 2011, the disclosure of which is hereby incorporated by reference herein in its entirety.

TECHNICAL FIELD

The present invention relates to a scroll fluid machine, and more particularly to a scroll fluid machine in which a pin crank mechanism is not provided in a compression chamber where compression is performed, thereby eliminating the need to provide a bearing in the compression chamber with the result that damage to the bearing in the compression chamber can be avoided.

BACKGROUND ART

A scroll fluid machine is known in the related art as a type of compressor used for air compression, refrigeration, and air-conditioning. A scroll fluid machine typically includes a revolving scroll having a revolving wrap that stands upright on an end plate supported on a drive shaft, and a fixed scroll having a fixed wrap that stands upright on an end plate, wherein the revolving wrap and the fixed wrap are intermeshed such that an enclosed compression chamber is formed between the revolving wrap and the fixed wrap.

In the scroll fluid machine, the drive shaft is caused to revolve eccentrically such that a volume of the compression chamber is gradually reduced in a centripetal direction by a relative motion between the revolving wrap and the fixed wrap. Meanwhile, a fluid suctioned from an outer peripheral portion of the compression chamber is led to a central portion while being compressed, whereupon the compressed fluid is discharged.

In the scroll fluid machine having this configuration, a rotation prevention mechanism that prevents the revolving scroll from rotating by restricting a revolving region thereof is provided to cause the revolving scroll to perform a revolving motion relative to the fixed scroll. A pin crank mechanism is known as a type of rotation prevention mechanism. The pin crank mechanism restricts the motion of the revolving scroll by coupling the revolving scroll side to the fixed scroll side via a pin crank shaft. Patent Document 1, for example, discloses a technique employed in a scroll fluid machine having a pin crank mechanism in which a revolving scroll side pin portion and a fixed scroll side pin portion are provided separately, whereupon the two pin portions are fitted together to form an integrated pin crank shaft.

Further, Patent Document 2 discloses a double wrap type scroll fluid machine that includes a single revolving scroll in which revolving wraps are formed one by one on each of axial direction surface, and a pair of fixed scrolls each having a fixed wrap that is fitted to the respective wraps of the revolving scroll. In a double wrap type scroll fluid machine of this type, the revolving wrap is often supported and restricted in an axial direction using a resin member known as a tip seal.

Furthermore, as a technique employed in a single wrap type scroll fluid machine in relation to a vacuum seal, Patent Document 3, for example, discloses a single wrap type scroll fluid machine in which a P seal (a dust seal), which is similar to a tip seal, is provided on an outermost periphery of a revolving portion separately from a tip seal.

Further, Non-Patent Document 1 discloses a technique for housing a bearing in a large-diameter bellows.

Patent Document 1: Japanese Patent Application Publication No. 2003-201977

Patent Document 2: Japanese Patent Application Publication No. H5-187372

Patent Document 3: Japanese Patent Application Publication No. 2005-320885

Non-Patent Document 1: XDS Scroll Pump, Internet <http://www.edwardsvacuum.com/Products/List.aspx?r=3>

DISCLOSURE OF THE INVENTION

However, in a scroll fluid machine employing a pin crank mechanism, such as those disclosed in Patent Documents 1 and 2, for example, the pin crank mechanism exists in a compression chamber where compression is performed. The pin crank mechanism requires a bearing, and therefore, in a scroll fluid machine in which the pin crank mechanism exists in the compression chamber, foreign matter adhered to bearing grease and corrosive gas may cause the bearing grease to deteriorate and the bearing to be damaged. Further, to replenish the bearing grease, the compression chamber of the scroll fluid machine must be dismantled, and therefore bearing grease replenishment is time-consuming and laborious. Moreover, it is necessary either to lubricate the bearing using grease or to employ a dry bearing as the bearing, and in both cases, costs relating to the bearing increase.

Furthermore, when, in a double wrap type scroll fluid machine such as that disclosed in Patent Document 2, the revolving wrap is supported and restricted in the axial direction using a tip seal, the revolving wrap and the fixed wrap come into contact so as to interfere with each other as wear on the tip seal progresses. The tip seal must therefore be replaced before becoming worn to the extent that such contact and interference occur. As a result, an operating time of the scroll fluid machine is reduced by being dependent on a working life of the tip seal.

Note that in the majority of single wrap type scroll fluid machines, the revolving wrap is supported in the axial direction by a bearing rather than a tip seal, and therefore, although a sealing performance deteriorates as wear on the tip seal progresses, contact and interference do not occur. However, when the axial direction is supported by a bearing, the bearing must be increased in size and provided with a complicated structure such as that of an angular contact ball bearing so that the bearing can bear a load, and as a result, the bearing cannot easily be disposed in the compression chamber.

Hence, a vacuum seal technique such as that disclosed in Patent Document 3 or Non-Patent Document 1 may be applied. However, when the vacuum seal technique disclosed in Patent Document 3 is applied, the P seal is a contact type seal and therefore becomes worn. Hence, the P seal must be replaced frequently, similarly to a tip seal. Moreover, the P seal has a much greater effect on a vacuum performance than a tip seal.

Further, when the vacuum seal technique disclosed in Non-Patent Document 1 is applied, the lifespan of the bellows is short, and bearing grease replenishment is laborious.

The present invention has been designed in consideration of these problems in the related art, and an object thereof is to provide a scroll fluid machine that can also be applied to a double wrap type scroll fluid machine, in which a pin crank mechanism is not provided in an interior of a compression chamber, thereby eliminating the need to provide a bearing in the compression chamber, and in which there is no need to support and restrict an axial direction using a resin material known as a tip seal, with the result that a continuous operating time of the scroll fluid machine can be lengthened.

To solve the problems described above, the present invention is a scroll fluid machine including a revolving scroll in which a revolving wrap stands upright on an endplate supported revolvably on a drive shaft, and a fixed scroll which is provided opposite the revolving scroll and in which a fixed wrap stands upright on an end plate, wherein the revolving wrap and the fixed wrap are overlapped so as to form a compression chamber for compressing a fluid by causing the revolving scroll to revolve, the scroll fluid machine further including: a rod-shaped member that is attached to the endplate of the revolving scroll and extends to a rear surface side of the fixed scroll, which is a side not opposing the revolving scroll; and a revolving plate that is attached to the rod-shaped member, provided with a pin crank mechanism, and supported revolvably on the drive shaft, the revolving plate being provided with a sealing unit that seals the compression chamber.

By providing the revolving plate, the revolving scroll, which is fixed to the revolving plate via the rod-shaped member, is caused to rotate by causing the revolving plate to revolve using the drive shaft. Hence, the pin crank mechanism may be provided on the revolving plate that is caused to revolve directly by driving the drive shaft. Since the revolving plate is positioned outside the compression chamber in which compression is performed, there is no need to provide the pin crank mechanism in the compression chamber, and therefore a bearing related to the pin crank mechanism does not have to be provided inside the compression chamber. As a result, the problems occurring in the related art due to the existence of a bearing in the compression chamber, namely the possibility of bearing grease deterioration and damage to the bearing caused by the adhesion of foreign matter to the grease and corrosive gas, the increases in time and labor relating to the dismantling operation required to replenish the bearing grease, and the cost increase incurred when grease is used to lubricate the bearing or a dry bearing is used as the bearing, do not arise.

Furthermore, by providing the sealing unit, the need to seal the compression chamber in an axial direction using a tip seal constituted by a resin material is eliminated, enabling an increase in the continuous operating time of the scroll fluid machine.

Further, the sealing unit is preferably a bellows provided between the rear surface side of the fixed scroll and the revolving plate, and the bellows is preferably provided to surround an outer peripheral side of the rod-shaped member in a space between the rear surface side of the fixed scroll and the revolving plate.

By providing the bellows, the compression chamber can be sealed in the axial direction without the use of a tip seal. Moreover, the bellows need only cover the periphery of the rod-shaped member, and therefore a diameter of the bellows can be reduced. As a result, a lifespan of the bellows can be increased, leading to an increase in the operating time of the scroll fluid machine.

The sealing unit may also be a bellows provided between the rear surface side of the fixed scroll and the rod-shaped member. In this case, the bellows is preferably provided in a space between the rear surface side of the fixed scroll and the revolving plate such that one end thereof is attached to the rod-shaped member around an entire outer periphery of the rod-shaped member, and another end thereof is attached to the rear surface side of the fixed scroll while surrounding the outer peripheral side of the rod-shaped member.

Thus, a distance between the fixed scroll and the revolving plate can be shortened, enabling an increase in an overall compactness of the scroll fluid machine.

The sealing unit may also have a ring-shaped projection provided on a surface of the revolving plate that opposes the rear surface side of the fixed scroll. In this case, a tip end of the projection preferably contacts the rear surface side of the fixed scroll to be capable of sliding thereon, and the projection is preferably provided to surround an outer peripheral side of the rod-shaped member.

Thus, the projecting portion serving as the sealing unit and the revolving plate are integrated, and therefore the present invention can be implemented with a simple structure.

Further, a second fixed wrap may stand upright on the rear surface of the fixed scroll, a second revolving wrap may stand upright on a surface of the revolving plate that opposes the rear surface side of the fixed scroll, and the sealing unit may be a second compression chamber that is formed when the second revolving wrap and the second fixed wrap are overlapped and that compresses the fluid by causing the revolving scroll to revolve.

Hence, a further compression chamber is provided, leading to an improvement in a compression performance of the scroll fluid machine. In this case, in the second compression chamber, pressure reaches a maximum in the vicinity of a center thereof, and therefore the second compression chamber serves as a seal, or in other words has a self-pressurizing purge type configuration, with which gas from the compression chamber is prevented from leaking to the outside in the axial direction.

Furthermore, a connecting passage connecting the compression chamber to the outside is preferably provided in the rod-shaped member such that a cooling fluid can be introduced into the compression chamber from the outside through the connecting passage.

Thus, air or a coolant can be introduced into the compression chamber through the connecting passage such that the interior of the compression chamber can be cooled easily. In this case, two connecting passages are preferably provided in the rod-shaped member, one of which is used as an introduction port for introducing the cooling fluid and the other of which is used as a cooling fluid discharge port. In so doing, the cooling fluid can be introduced into and discharged from the compression chamber continuously.

According to the present invention, a scroll fluid machine in which a pin crank mechanism is not provided in a compression chamber, thereby eliminating the need to provide a bearing in the compression chamber and enabling an increase in a continuous operating time of the scroll fluid machine, can be provided.

BEST MODE FOR CARRYING OUT THE INVENTION

Preferred exemplary embodiments of the present invention will be described in detail below with reference to the drawings. Note, however, that unless specific description is provided to the contrary, dimensions, materials, shapes, relative arrangements, and the like of constituent components described in the embodiments are not intended to limit the scope of the present invention, and are merely descriptive examples.

First Embodiment

Figure 1:
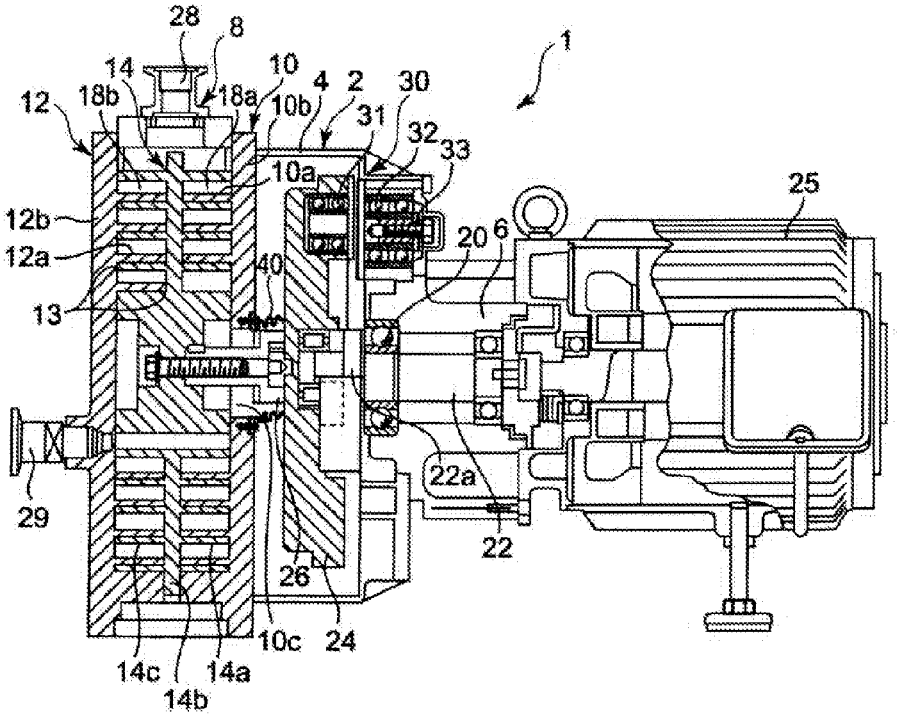
FIG. 1 is a side view showing a partial cross-section of a scroll fluid machine according to a first embodiment.

FIG. 1 is a side view showing a partial cross-section of a scroll fluid machine according to a first embodiment.

First, a configuration of a scroll fluid machine according to the first embodiment will be described on the basis of FIG. 1.

In a scroll fluid machine 1 shown in FIG. 1, 2 denotes a compressor casing forming an outer frame of the scroll fluid machine 1. The compressor casing 2 is schematically constituted by a casing main body 4 that is open on one side, and a tubular bearing portion 6 formed to project toward an opposite side to the opening in the casing main body 4.

A compression portion 8 forms a main body of the scroll fluid machine 1 and is schematically constituted by a fixed scroll 10 that is attached to the casing main body 4 by a back surface thereof and includes a plurality of fixed wraps 10*a* standing upright on a front surface thereof, a fixed scroll 12 that is provided opposite the fixed scroll 10 and includes a fixed wrap 12*a* standing upright on a surface thereof that opposes the fixed scroll 10, a revolving scroll 14 positioned between the fixed scroll 10 and the fixed scroll 12 in order to form compression chambers 18*a* and 18*b*, to be described below, in between the fixed scroll 10 and the fixed scroll 12, and a drive shaft 22 that is supported on the bearing portion 6 of the compressor casing 2 rotatably via a bearing 20 and coupled to the revolving scroll 14 via a revolving disc 24 and a rod-shaped boss 26, to be described below, on one end side, and projects from the bearing portion 6 on another end side. A motor 25 is connected to the drive shaft 22 either directly or via a belt (not shown), a pulley (not shown), or the like.

The fixed scroll 10 is schematically constituted by an end plate 10*b*, and the spiral fixed wrap 10*a* that stands upright on the front surface of the endplate 10*b* such that a winding starting end thereof is located in a center of the endplate 10*b*, and a winding terminal end thereof is located on an outer peripheral side of the end plate 10*b*. The fixed scroll 12 is configured similarly.

Further, the revolving scroll 14 is schematically constituted by an end plate 14*b*, and spiral revolving wraps 14*a* and 14*c* that stand upright on respective surfaces of the end plate 14*a* such that winding starting ends thereof are located in a center of the end plate 14*b* and winding terminal ends thereof are located on an outer peripheral side of the endplate 14*b*. Tip seals 13 for forming a seal are disposed in respective tip end portions of the fixed wraps 10*a*, 12*a* and the revolving wraps 14*a*, 14*c*.

Note that the respective end plates 10*b*, 12*b*, 14*b* and the drive shaft 22 are provided such that surfaces of the respective end plates 10*b*, 12*b*, 14*b* are orthogonal to the drive shaft 22. The revolving wrap 14*a* of the revolving scroll 14 is disposed to overlap the fixed wrap 10*a* of the fixed scroll 10 at an offset of a predetermined angle such that the compression chamber 18*a* is formed between the fixed wrap 10*a* of the fixed scroll 10 and the revolving wrap 14*a* of the revolving scroll 14.

Similarly, the revolving wrap 14*c* of the revolving scroll 14 is disposed to overlap the fixed wrap 12*a* of the fixed scroll 12 at an offset of a predetermined angle such that the compression chamber 18*b* is formed between the fixed wrap 12*a* of the fixed scroll 12 and the revolving wrap 14*c* of the revolving scroll 14.

Further, the revolving disc 24 is attached to a compression portion 8 side tip end portion of the drive shaft 22. The revolving disc 24 is provided parallel to the endplate 10*b* of the fixed scroll 10, and the tip end of the drive shaft 22 is attached to a central portion thereof.

The rod-shaped boss 26 is attached to an opposite side surface of the revolving disc 24 to the surface to which the drive shaft 22 is attached. One end of the boss 26 is attached to the revolving disc 24 in an identical direction to an axial direction of the drive shaft 22, while the other end is passed through a through portion 10*c* provided in the end plate 10*a* of the fixed scroll 10 and attached to the end plate 14*b* of the revolving scroll 14.

Further, an eccentric shaft 22*a* forming one end of the drive shaft 22 is attached to the revolving disc 24. Furthermore, a pin crank mechanism 30 constituted by a roller bearing 31 provided on the revolving disc 24 and a pin crank shaft 33 that is supported by a roller bearing 32 provided on the compressor casing 2, both disposed in triplicate at equal circumferential intervals as a rotation prevention mechanism that prevents rotation about the eccentric shaft from acting on the revolving disc 24 so as to restrict a revolving motion.

In the compression portion 8, when the drive shaft 22 is driven to rotate by driving the motor 25, the revolving scroll 14 performs a revolving motion at a desired turning radius relative to the fixed scrolls 10 and 12 via the revolving disc 24 and the boss 26 connected to the drive shaft 22. As a result, a compression subject (air or the like) suctioned through an air introduction port 28 provided on an outer peripheral side of the compression portion 8 is successively compressed in the compression portion 8, and then transferred to a compressed air supply destination through a discharge port 29.

Further, a bellows 40 is provided to connect a back surface of the fixed scroll 10 to a surface of the revolving disc 24 that opposes the back surface. The bellows 40 is provided between the fixed scroll 10 and the revolving disc 24 so as to surround an entire circumferential direction periphery of the boss 26.

According to the first embodiment, by providing the revolving disc 24, the revolving scroll 14, which is fixed to the revolving disc 24 via the boss 26, is caused to revolve by causing the revolving disc 24 to revolve using the drive shaft 22. Hence, the pin crank mechanism may be provided on the revolving disc 24 that is caused to revolve directly by driving the drive shaft 22. Since the revolving disc 24 is positioned outside the compression portion 8, there is no need to provide a pin crank mechanism in the compression portion 8, and therefore bearings related to the pin crank mechanism do not have to be provided inside the compression portion 8. As a result, the problems occurring in the related art due to the existence of a bearing in the compression portion 8, namely the possibility of bearing grease deterioration and damage to the bearing caused by the adhesion of foreign matter to the grease and corrosive gas, the increases in time and labor relating to the dismantling operation required to replenish the bearing grease, and the cost increase incurred when grease is used to lubricate the bearing or a dry bearing is used as the bearing, do not arise.

Moreover, there is no need to provide a pin crank mechanism on an outer peripheral side of the compression portion 8, and therefore the compression portion 8 can be made more compact, enabling an increase in an overall compactness of the scroll fluid machine.

Furthermore, by providing the bellows 40, the compression portion 8 can be sealed in the axial direction without the use of a tip seal. Further, the bellows 40 needs only to surround the periphery of the rod-shaped boss 26, and therefore a diameter of the bellows can be reduced. As a result, a lifespan of the bellows 40 can be increased, leading to an increase in an operating time of the scroll fluid machine 1.

Moreover, even in a double wrap type scroll fluid machine, as described in this embodiment, the revolving scroll is supported by the boss, and therefore an interval can be maintained between the revolving scroll 14 and the fixed scrolls 10, 12 even when the tip seals 13 become worn. As a result, contact between the revolving scroll 14 and the fixed scrolls 10, 12 can be prevented.

Further, by providing a connecting passage (not shown) connecting the compression chambers 18*a*, 18*b* to the outside in the boss 26, air or a coolant can be introduced through the connecting passage such that the interiors of the compression chambers can be cooled easily.

In this case, two connecting passages are preferably provided in the boss 26, one of which is used as an introduction port for introducing a fluid such as air or a coolant and the other of which is used as a fluid discharge port. In so doing, the fluid can be introduced into and discharged from the compression chambers continuously.

Second Embodiment

Figure 2:
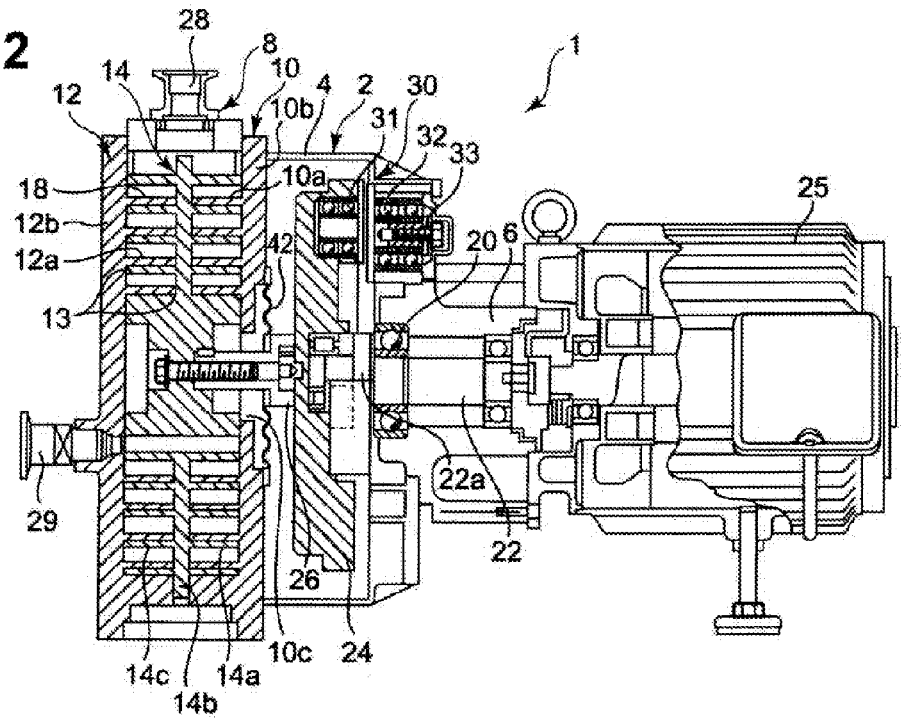
FIG. 2 is a side view showing a partial cross-section of a scroll fluid machine according to a second embodiment.

FIG. 2 is a side view showing a partial cross-section of a scroll fluid machine according to a second embodiment.

In FIG. 2, identical reference symbols to FIG. 1 represent identical objects, and description thereof has been omitted.

In FIG. 2, a bellows 42 is provided in place of the bellows 40 shown in FIG. 1. The bellows 42 is provided over the entire periphery of the boss 26 to connect the rear surface (the surface opposing the revolving disc 24) of the fixed scroll 10 to the boss 26. The compression portion 8 can likewise be sealed in the axial direction by providing the bellows 42 in the manner shown in FIG. 2.

According to the second embodiment, in addition to similar effects to the first embodiment, a distance between the fixed scroll 10 and the revolving disc 24 can be shortened, enabling a further increase in the overall compactness of the scroll fluid machine 1.

Third Embodiment

Figure 3:
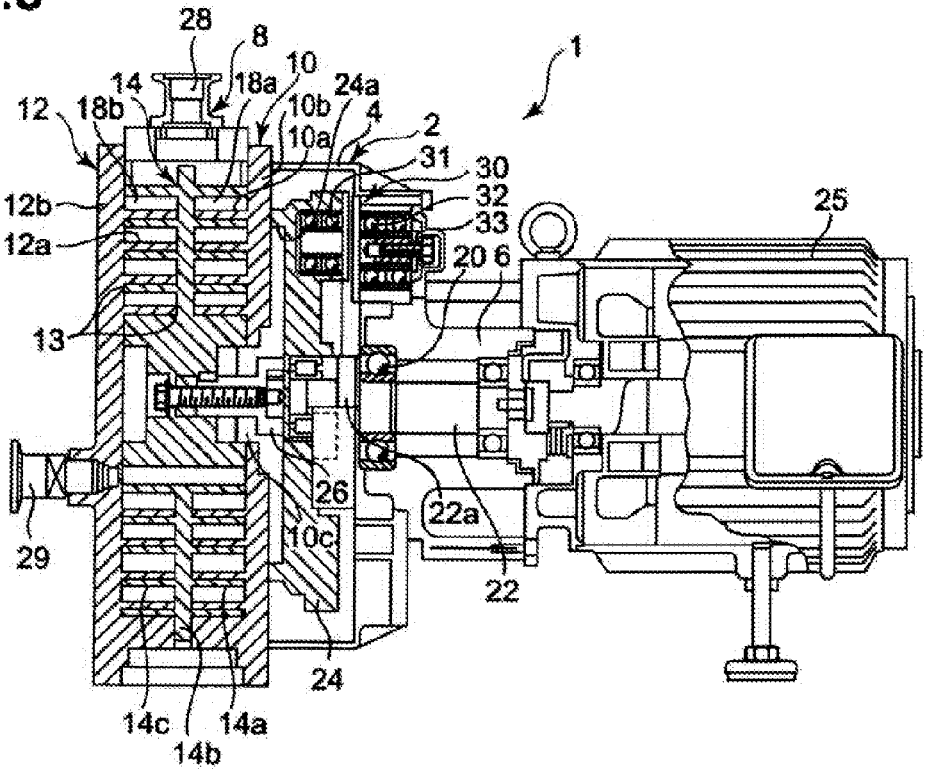
FIG. 3 is a side view showing a partial cross-section of a scroll fluid machine according to a third embodiment.

FIG. 3 is a side view showing a partial cross-section of a scroll fluid machine according to a third embodiment.

In FIG. 3, identical reference symbols to FIG. 1 or FIG. 2 represent identical objects, and description thereof has been omitted.

In FIG. 3, the bellows 40 shown in FIG. 1 and the bellows 42 shown in FIG. 2 are not provided.

Instead, a ring-shaped projecting portion 24*a* is provided on the surface of the revolving disc 24 that opposes the fixed scroll 10. The projecting portion 24*a* is provided so as to surround the boss 26 and configured such that a tip end thereof contacts the surface of the fixed scroll 10 that opposes the revolving disc, whereby the tip end slides over the surface of the fixed scroll 10 as the revolving disc 24 revolves. As a result, the compression portion 8 can be sealed in the axial direction by the projecting portion 24*a*.

According to the third embodiment, in addition to similar effects to the first embodiment, a bellows is not required, and therefore the present invention can be implemented with a simple structure.

Fourth Embodiment

Figure 4:
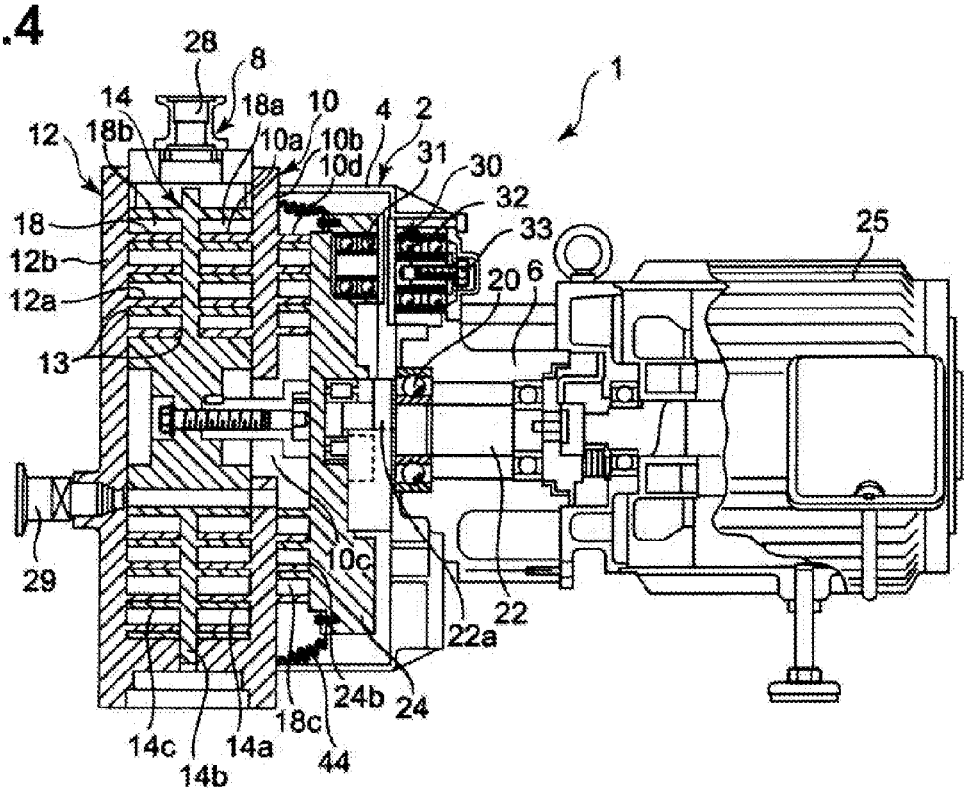
FIG. 4 is a side view showing a partial cross-section of a scroll fluid machine according to a fourth embodiment.

FIG. 4 is a side view showing a partial cross-section of a scroll fluid machine according to a fourth embodiment.

In FIG. 4, identical reference symbols to FIGS. 1 to 3 represent identical objects, and description thereof has been omitted.

In FIG. 4, the revolving disc 24 side surface of the fixed scroll 10 is provided with a further spiral fixed wrap 10*d* that stands upright on the surface of the endplate 10*b* such that a winding starting end thereof is located in the center of the endplate 10*b*, and a winding terminal end thereof is located on the outer peripheral side of the end plate 10*b*.

Further, the fixed scroll 10 side surface of the revolving disc 24 is provided with a spiral revolving wrap 24*b* that stands upright on the surface of the revolving disc 24 such that a winding starting end thereof is located in a center of the revolving disc 24, and a winding terminal end thereof is located on an outer peripheral side of the revolving disc 24.

The revolving wrap 24*b* of the revolving disc 24 is disposed to overlap the fixed wrap 10*d* of the fixed scroll 10 at an offset of a predetermined angle such that a compression chamber 18*c* is formed between the fixed wrap 10*d* of the fixed scroll 10 and the revolving wrap 24*b* of the revolving disc 24.

Furthermore, a bellows 44 is provided so as to connect the back surface of the fixed scroll 10 to the surface of the revolving disc 24 that opposes the back surface. The bellows 44 is provided as an axial direction seal between the fixed scroll 10 and the revolving disc 24 so as to surround an entire circumferential direction periphery of the fixed wrap 10*d* and the revolving wrap 24*d* on an outermost peripheral side thereof.

According to the fourth embodiment, in addition to similar effects to the first embodiment, three compression chambers, namely the compression chambers 18*a*, 18*b*, and 18*c*, are provided, and therefore a superior compression performance can be exhibited.

Fifth Embodiment

Figure 5:
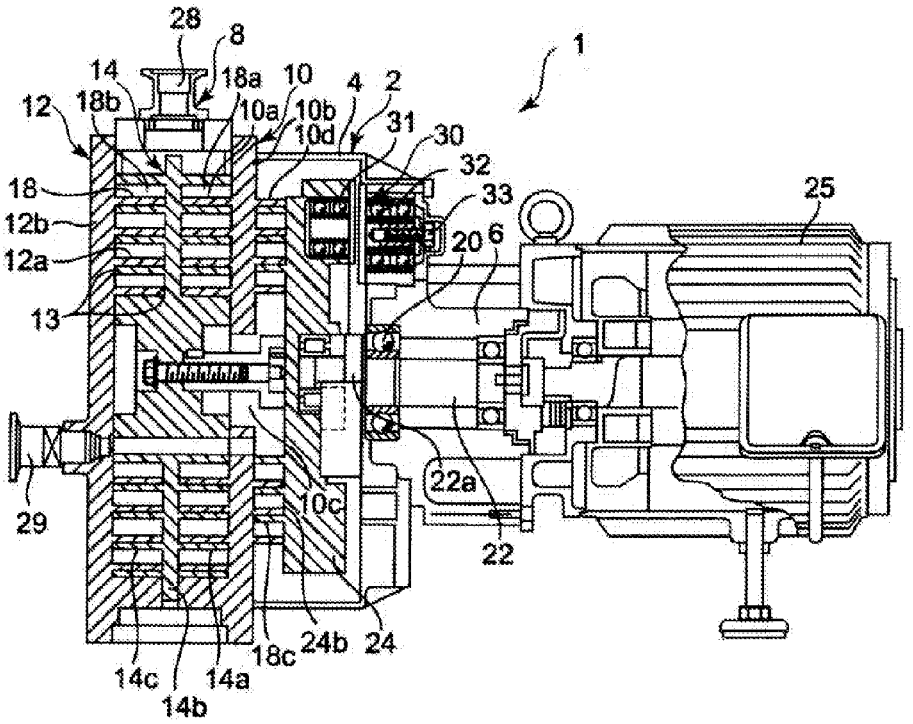
FIG. 5 is a side view showing a partial cross-section of a scroll fluid machine according to a fifth embodiment.

FIG. 5 is a side view showing a partial cross-section of a scroll fluid machine according to a fifth embodiment.

In FIG. 5, identical reference symbols to FIG. 4 represent identical objects, and description thereof has been omitted.

FIG. 5 is configured similarly to FIG. 4 except that the bellows 44 is not provided.

Likewise in this case, as described above, in the compression chamber 18*c*, pressure reaches a maximum in the vicinity of the center thereof. Therefore, the compression chamber 18 serves as a seal, or in other words has a self-pressurizing purge type configuration, with which gas from the compression chambers 18*a* and 18*b* is prevented from leaking to the outside.

According to the configuration of the fifth embodiment, in addition to the effects of the fourth embodiment, a bellows is not required, and therefore the structure of the scroll fluid machine 1 can be simplified correspondingly.

INDUSTRIAL APPLICABILITY

The present invention can be used as a scroll fluid machine in which a pin crank mechanism is not provided in an interior of a compression chamber, thereby eliminating the need to provide a bearing in the compression chamber, and in which there is no need to seal an axial direction using a resin material known as a tip seal, with the result that a continuous operating time of the scroll fluid machine can be lengthened.

The invention claimed is:

1. A scroll fluid machine comprising a revolving scroll in which a revolving wrap stands upright on an end plate supported revolvably on a drive shaft, and a fixed scroll which is provided opposite the revolving scroll and in which a fixed wrap stands upright on an end plate, wherein the revolving wrap and the fixed wrap are overlapped so as to form a compression chamber for compressing a fluid when the revolving scroll is revolved, the scroll fluid machine further comprising:

a rod-shaped member that is attached to the end plate of the revolving scroll and extends to a rear surface side of the fixed scroll, which is a side not opposing the revolving scroll;

a pin crank mechanism disposed on a revolving plate that is attached to the rod-shaped member and revolved by driving of the drive shaft;

and a sealing unit that seals the compression chamber in an axial direction, the sealing unit being disposed between the revolving plate or the rod-shaped member and the rear surface side of the fixed scroll not opposing the revolving scroll.

2. The scroll fluid machine according to claim 1, wherein the sealing unit is a bellows provided between the rear surface side of the fixed scroll and the rod-shaped member, and the bellows is provided in a space between the rear surface side of the fixed scroll and the revolving plate such that one end thereof is attached to the rod-shaped member around an entire outer periphery of the rod-shaped member, and another end thereof is attached to the rear surface side of the fixed scroll while surrounding the outer peripheral side of the rod-shaped member.

3. The scroll fluid machine according to claim 1, wherein the sealing unit has a ring-shaped projection provided on a surface of the revolving plate that opposes the rear surface side of the fixed scroll, a tip end of the rod-shaped member contacts the rear surface side of the fixed scroll to be capable of sliding thereon, and the rod-shaped member is provided to surround an outer peripheral side of the boss.

4. The scroll fluid machine according to claim 1, wherein a second fixed wrap stands upright on the rear surface of the fixed scroll, a second revolving wrap stands upright on a surface of the revolving plate that opposes the rear surface side of the fixed scroll, and the sealing unit is a second compression chamber that is formed when the second revolving wrap and the second fixed wrap are overlapped and that compresses the fluid by causing the revolving scroll to revolve.

* * * * *